US011846104B2

(12) United States Patent
Leary

(10) Patent No.: US 11,846,104 B2
(45) Date of Patent: Dec. 19, 2023

(54) WOOD POST BRACKET

(71) Applicant: Vinylast, Inc., Lakewood, NJ (US)

(72) Inventor: Steven J. Leary, Barnegat, NJ (US)

(73) Assignee: Vinylast, Inc., Lakewood, NJ (US)

( * ) Notice: Subject to any disclaimer, the term of this patent is extended or adjusted under 35 U.S.C. 154(b) by 214 days.

(21) Appl. No.: 17/027,218

(22) Filed: Sep. 21, 2020

(65) Prior Publication Data

US 2022/0090385 A1 Mar. 24, 2022

(51) Int. Cl.
*E04F 11/18* (2006.01)

(52) U.S. Cl.
CPC ... *E04F 11/1817* (2013.01); *E04F 2011/1821* (2013.01); *E04F 2011/1887* (2013.01)

(58) Field of Classification Search
CPC ..... E04H 17/009; E04H 17/20; E04H 17/22; E04H 17/23; E04F 11/1812; E04F 11/1817; E04F 2011/1819
See application file for complete search history.

(56) References Cited

U.S. PATENT DOCUMENTS 2,667,317 A * 1/1954 Trebules ..... H01Q 1/084 52/298
3,615,110 A * 10/1971 Fugate ..... F16B 7/00 403/230
4,644,713 A * 2/1987 Lehman ..... E02D 5/80 52/165
4,910,939 A 3/1990 Cavanagh
5,186,571 A * 2/1993 Hentzschel ..... E04H 17/1413 403/231
5,374,024 A * 12/1994 Williams ..... F16M 11/046 248/514
5,392,575 A * 2/1995 Hoffman ..... E04B 1/003 D25/138
5,568,909 A * 10/1996 Timko ..... E04H 12/2261 52/298

(Continued)

FOREIGN PATENT DOCUMENTS

FR 939923 A 11/1948
FR 74963 E 3/1961
GB 104632 A 3/1917

OTHER PUBLICATIONS

Transmittal of the International Search Report and the Written Opinion of the International Searching Authority, International application No. PCT/US2020/052043, dated Dec. 15, 2020.

*Primary Examiner* — Jonathan P Masinick

(57) ABSTRACT

A wood post bracket used for securing a wood post to a rim joist and a reinforcing block directly linking to a substructure of a deck's wood framing system includes a planar base having a first end and a second end, a first flange extending from the first end of the planar base in a perpendicular orientation relative to the planar base, a second flange extending from the second end of the planar base in a perpendicular orientation relative to the planar base, and a hollow sleeve extending from the planar base in a perpendicular orientation relative to the planar base, wherein the hollow sleeve is positioned between the first end of the planar base and the second end of the planar base. The bracket comprises a direct link tying the top of the post to the deck sub structure, allowing for quick, easy, and secure, code-compliant post installation.

20 Claims, 13 Drawing Sheets

(56) References Cited

U.S. PATENT DOCUMENTS

| | | | | |
|---|---|---|---|---|
| 6,327,830 | B1 * | 12/2001 | Hecht | A47B 96/06 256/65.01 |
| 7,134,636 | B2 * | 11/2006 | Callies | E04H 12/2269 248/300 |
| 8,141,830 | B1 * | 3/2012 | Hudson | E04G 21/1808 33/408 |
| 8,870,163 | B2 * | 10/2014 | Regan | E04F 11/1812 52/298 |
| 8,959,849 | B1 * | 2/2015 | DiGirolamo | E04B 1/003 52/715 |
| 9,388,540 | B2 * | 7/2016 | Koering | E04G 5/14 |
| 10,174,498 | B2 * | 1/2019 | Winter | E04B 1/2403 |
| 2003/0196394 | A1 * | 10/2003 | Hoffman | E02D 27/02 52/704 |
| 2012/0241703 | A1 | 9/2012 | Regan | |

* cited by examiner

200

206

206

200

WOOD POST BRACKET

FIELD OF THE INVENTION

The present invention relates generally to railing systems and relates more specifically to support hardware for use in railing systems.

BACKGROUND OF THE DISCLOSURE

One common style of decking system comprises vertically oriented posts that are supported by a wood substructure or framing system that includes joists. The posts, in turn, support a railing which may be oriented in a manner parallel to the joists or in a manner that is angled relative to the joists (e.g., as may be the case on a railing that is adjacent to stairs). The posts are typically coupled to the joists by fasteners (e.g., lag bolts or lag screws) which are lagged through the posts and joists (e.g., drilled directly through, without any pre-drilled holes being formed in either the posts or the joists).

SUMMARY OF THE INVENTION

In one example, a wood post bracket used for securing a wood post to a rim joist and a reinforcing block directly linking to the substructure of a deck's wood framing system includes a planar base having a first end and a second end, a first flange extending from the first end of the planar base in a perpendicular orientation relative to the planar base, a second flange extending from the second end of the planar base in a perpendicular orientation relative to the planar base, and a hollow sleeve extending from the planar base in a perpendicular orientation relative to the planar base, wherein the hollow sleeve is positioned between the first end of the planar base and the second end of the planar base.

In another example, a method for securing a post to a rim joist of a deck frame includes providing a bracket, wherein the bracket comprises a planar base having a first end and a second end, a first flange extending from the first end of the planar base in a perpendicular orientation relative to the planar base, a second flange extending from the second end of the planar base in a perpendicular orientation relative to the planar base; and a hollow sleeve extending from the planar base in a perpendicular orientation relative to the planar base, wherein the hollow sleeve is positioned between the first end of the planar base and the second end of the planar base. The method further includes positioning the bracket beneath and around the rim joist, so that the rim joist sits between the first flange and the hollow sleeve, inserting the post into the hollow sleeve, and lagging a first fastener through the first flange, the rim joist, and the hollow sleeve, and into the post.

In another example, a wood post bracket for securing a post to a rim joist of a deck's wood framing system includes a hollow sleeve having a first side, a second side, a third side, and a fourth side arranged to form a rectangular tube, wherein the rectangular tube has a first end that is closed and a second end that is open, a planar base coupled to the first end of the rectangular tube and extending from the first side of the rectangular tube in a perpendicular orientation relative to the hollow sleeve, and a first flange extending from an end of the planar base in a parallel orientation relative to the hollow sleeve.

BRIEF DESCRIPTION OF THE DRAWINGS

The Teachings of the Present Disclosure can be Readily Understood by Considering the Following Detailed Description in Conjunction with the Accompanying Drawings, in which.

To facilitate understanding, identical reference numerals have been used, where possible, to designate identical elements that are common to the figures.

DETAILED DESCRIPTION

The present disclosure describes a novel bracket and a method for securing wood posts in a decking system. In one example, a wood post bracket secures a wood post directly to the rim joist, to the reinforcing block, and to the substructure of the deck's wood framing system. The bracket thus allows the rim joist, reinforcing block, and deck framing to work together to reinforce the vertical wood post quickly and easily with a code compliant installation.

As discussed above, one common style of decking system comprises vertically oriented posts that are supported by a wood substructure or framing system that includes joists. The posts are typically secured to the joists by fasteners (e.g., lag bolts or lag screws) which are drilled directly through the posts and joists, without any pre-drilled holes being formed in either the posts or the joists.

Current building codes require that outward movement of a post (i.e., movement in a direction away from the joist to which the post is secured) is not greater than a threshold. Conventionally, the outward movement of the post may be limited by securing a reinforcing block to the post, on the opposite side of the post from the joist. For instance, the fastener may be lagged through the joist, post, and reinforcing block, so that the post is held between the joist and the reinforcing block. However, building codes that are scheduled for implementation in the coming years not only further limit the permitted outward movement of the post, but also limit the permitted inward movement (i.e., movement in a direction toward the joist to which the post is secured) and lateral movement (i.e., sideways movement of the post along the joist to which the post is secured). Although a reinforcing block as described above may provide adequate protection against outward movement of a post, and may also provide some protection against inward movement, the reinforcing block does little to limit the lateral movement of the post. Thus, conventional methods of securing posts to joists are unlikely to ensure compliance with the expected changes in the building codes.

Examples of the present disclosure provide a bracket that may be installed on and under the rim joist of a decking system and a reinforcing block. The bracket includes a sleeve or pocket into which the post may be inserted, and includes apertures so that fasteners may be driven through the rim joist, sleeve, post, and reinforcing block. The bracket acts as a counter pivot to loads exerted on the post in all directions, so that outward, inward, and lateral movement of the post is minimized. The bracket allows the full width and height of the rim joist and the reinforcing block to work together as a counter balance, pushing and pulling in opposite directions to transfer and distribute pressures and loads directly to the deck substructure, as opposed to using just the width of the rim joist for structural reinforcement of the post.

Figure 1:
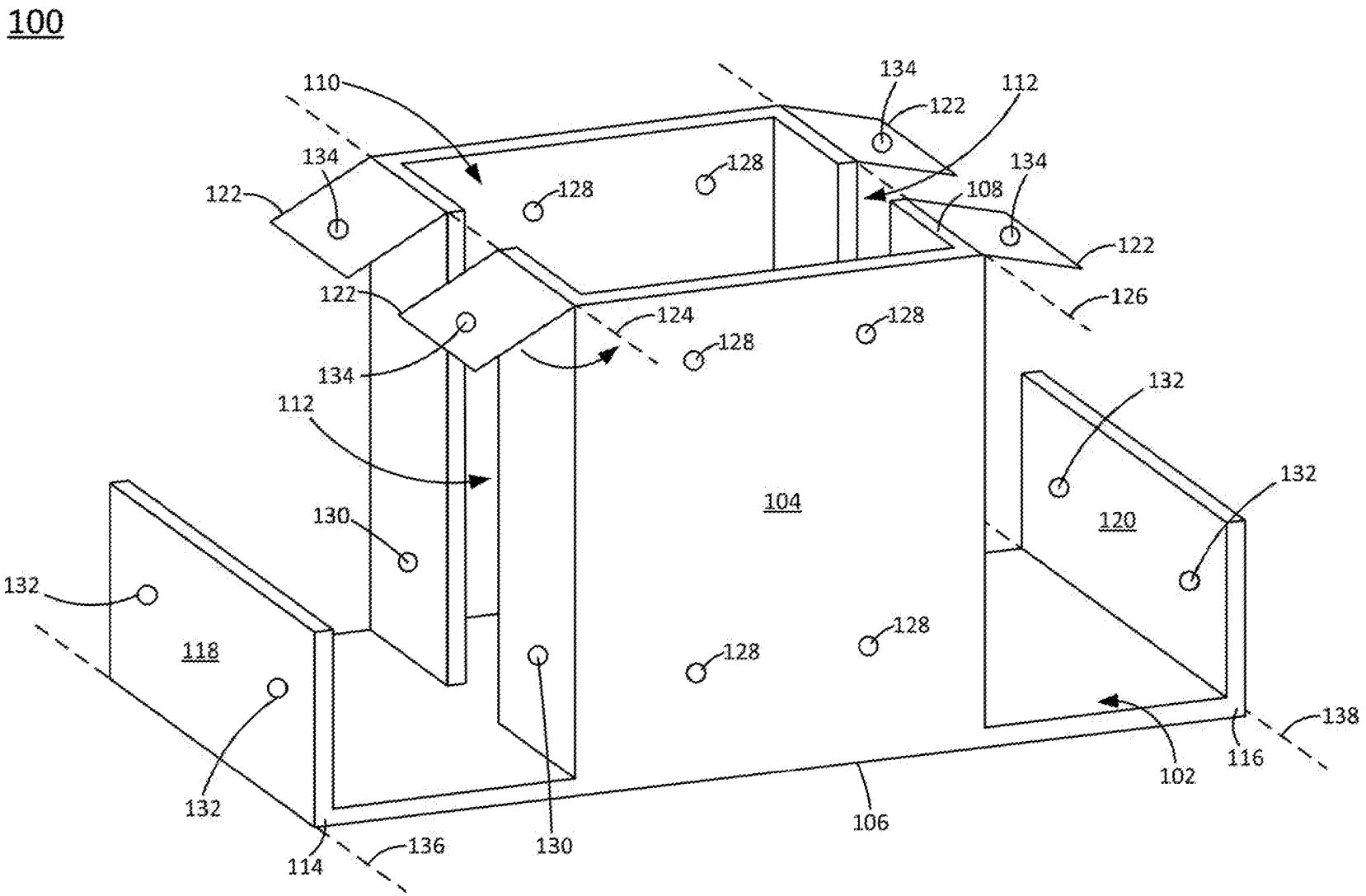
FIG. 1 illustrates an isometric view of one example of a bracket according to the present disclosure.

FIG. 1 illustrates an isometric view of one example of a bracket 100 according to the present disclosure. It should be noted that FIG. 1 is not necessarily to scale (e.g., some dimensions may be exaggerated to better show the features of the bracket 100). In one example, the bracket 100 is formed as a single, unitary piece fabricated from stamped metal. In other words, no fasteners are required to hold the different components or sections of the bracket together.

As illustrated, the bracket 100 generally takes the form of an upside down "T." Specifically, the bracket 100 comprises a planar base 102 having a generally rectangular shape.

At the center of the base 102 is a hollow sleeve 104 that extends from the base 102 at approximately a ninety degree angle (i.e., perpendicular relative to the base 102). The sleeve 104 may be sized and shaped to accommodate a wooden post, i.e., such that a wooden post can be inserted into the sleeve 104. Thus, in one example, the sleeve 104 may comprise four sides arranged to form a rectangular tube (i.e., a tube having a rectangular cross section) whose dimensions are sized such that a 4 inch by 4 inch post can be held snugly within the hollow interior of the tube.

In one example, two of the four sides of the sleeve 104 (i.e., two non-adjacent sides) each include a gap 112, such that there are breaks in the perimeter of the sleeve's cross section. In this case, the sleeve 104 may appear to be formed in two halves that are spaced apart from each other, as illustrated in FIG. 1. Forming the gaps 112 in the two sides of the sleeve 104 may reduce the amount of material required to fabricate the bracket 100. Alternatively or in addition, one or more of the sides of the sleeve 104 may include cutouts or windows cut into the planar surface of the side to further reduce material usage. However, in other examples, the sleeve 104 may be formed to have a continuous perimeter (e.g., without gaps or cutouts in any of the sides). In this case, the sleeve 104 may appear to be formed as a single, solid piece.

A first end 106 of the sleeve 104 is coupled directly to the base 102, such that the first end 106 of the sleeve 104 is closed. However, a second end 108 of the sleeve 104 defines an opening 110 into which the post may be inserted, as described in further detail below.

Referring back to the base 102, the base 102 may further include a first end 114 and a second end 116. The first end 114 and the second end 116 of the base 102 may be spaced equidistant from the sleeve 104 (e.g., such that the sleeve 104 is positioned midway between the first end 114 and the second end 116). In one example, the first end 114 comprises a first flange 118 that extends from the base 102 at approximately a ninety degree angle (i.e., perpendicular relative to the base 102, or parallel relative to the sleeve 104). Similarly, the second end 116 may comprise a second flange 120 that extends from the base 102 at approximately a ninety degree angle (i.e., perpendicular relative to the base 102, or parallel relative to the sleeve 104 and first flange 118). The first flange 118 and the second flange 120 may extend from the base 102 in the same direction as the sleeve 104. In one example, at least one of the first flange 118 and the second flange 120 may be hinged, e.g., such that the first flange 118 and the second flange 120 can rotate or bend to some degree around a respective bending axis 136 and 138, where the bending axes 136 and 138 run substantially parallel to the first flange 118 and the second flange 120.

In one example, the bracket 100 may further comprise a plurality of tabs 122 coupled to the perimeter of the second end 108 of the sleeve 104. In one example, a tab 122 may extend from each corner of the second end 108 of the sleeve 104, and the tabs 122 may be coupled to non-adjacent sides of the sleeve 104. For instance, in one example, a first tab 122 and a second tab 122 may extend outward from the sleeve 104, in a direction toward the first end 114 of the base 102. Similarly, a third tab 122 and a fourth tab 122 may extend outward from the sleeve 104, in a direction toward the second end 116 of the base 102. Each tab 122 may have a planar shape. The tabs 122 may be hinged, e.g., such that the tabs 122 can rotate or bend to some degree around respective bending axes 124 and 126, where the bending axes 124 and 126 run substantially parallel to the first flange 118 and the second flange 120.

In one example, the bracket 100 further comprises a plurality of apertures. The plurality of apertures may include a first plurality of apertures 128 that is formed in the sides of the sleeve 104. More specifically, the first plurality of apertures 128 may be formed in the sides of the sleeve 104 that do not have the tabs 122 coupled thereto (e.g., non-adjacent sides). In one example, some apertures 128 of the first plurality of apertures 128 are formed near the first end 106 of the sleeve, while some apertures 128 of the first plurality of apertures are formed near the second end 108 of the sleeve 104. In the example illustrated in FIG. 1, each side of the sleeve 104 that includes the first plurality of apertures 128 includes four apertures 128: two apertures 128 formed near the first end 106 of the sleeve 104 and two apertures 128 formed near the second end 108 of the sleeve 104.

The plurality of apertures may further include a second plurality of apertures 130 that is formed in the sleeve 104. More specifically, the second plurality of apertures 130 may be formed in the sides of the sleeve 104 that have the tabs 122 coupled thereto (e.g., non-adjacent sides). In one example, the second plurality of apertures 130 is formed near the first end 106 of the sleeve 104. In the example illustrated in FIG. 1, each side of the sleeve 104 that includes the second plurality of apertures 130 includes two apertures 130 formed near the first end 106 of the sleeve 104. The second plurality of apertures 130 may be situated closer to the base 102 than the lower apertures of the first plurality of apertures 128 that are formed near the first end 106 of the sleeve 104.

The plurality of apertures may further include a third plurality of apertures 132 that is formed in the flanges 118 and 120. In the example illustrated in FIG. 1, each of the first flange 118 and the second flange 120 includes two apertures 132. Each aperture of the third plurality of apertures 132 may be collinear with at least one aperture of the second plurality of apertures 130, e.g., such that a single fastener may pass through both an aperture of the second plurality of apertures and an aperture of the third plurality of apertures 132.

The plurality of apertures may further include a fourth plurality of apertures 134 that is formed in the tabs 122. In the example illustrated in FIG. 1, each tab 122 includes one aperture 134.

FIGS. 2A-2E are isometric views illustrating the installation of a post using the bracket 100 of FIG. 1. As such, FIGS. 2A-2E also serve as a flow diagram for a method of installing a post using the bracket 100 of FIG. 1. Similar reference numerals are used in FIG. 1 to refer to elements of the bracket 100 that is illustrated in FIG. 1. FIGS. 3A-3E are cross sectional views of certain steps of the installation illustrated in FIGS. 2A-2E, taken along line A-A' of FIG. 2B.

Figure 2A:
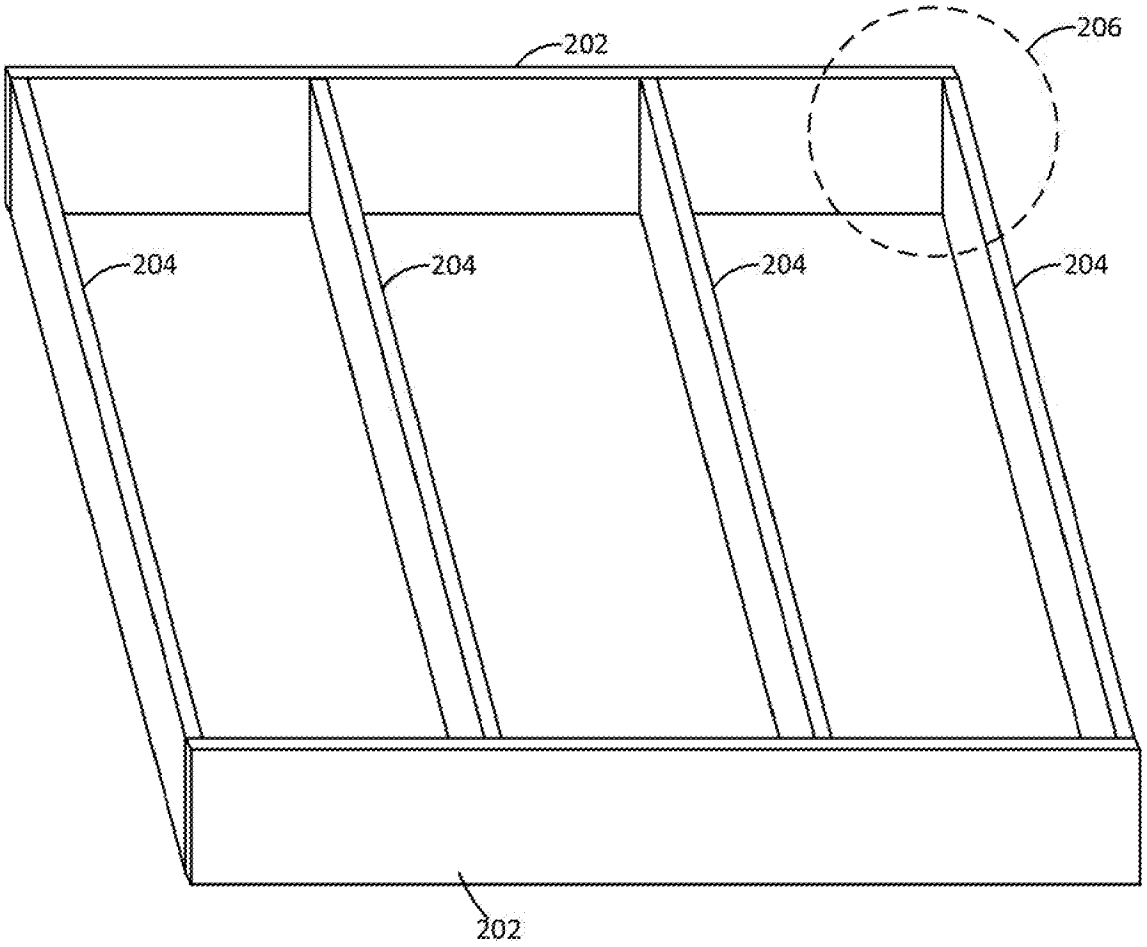
FIGS. 2A-2E are isometric views illustrating the installation of a post using the bracket of FIG. 1.

As illustrated in FIG. 2A, a wood frame 200 comprising a plurality of joists may be provided. It should noted that FIG. 2A may illustrate a portion of the frame 200; the full frame 200 may be larger than what is illustrated in FIG. 2A. The frame 200 may be provided as part of the substructure or support system for a deck, where each joist is one of a plurality of horizontal members that is arranged to support the deck. In one example, the plurality of joists may include rim joists 202, which form part of the perimeter of the frame 200 (e.g., the outside frame of the deck). For instance, FIG. 2A illustrates four rim joists 202 that are spaced apart from each other in a parallel manner. In addition, the plurality of joists may also include a plurality of deck joists 204 positioned inside the perimeter defined by the rim joists.

Figure 2B:
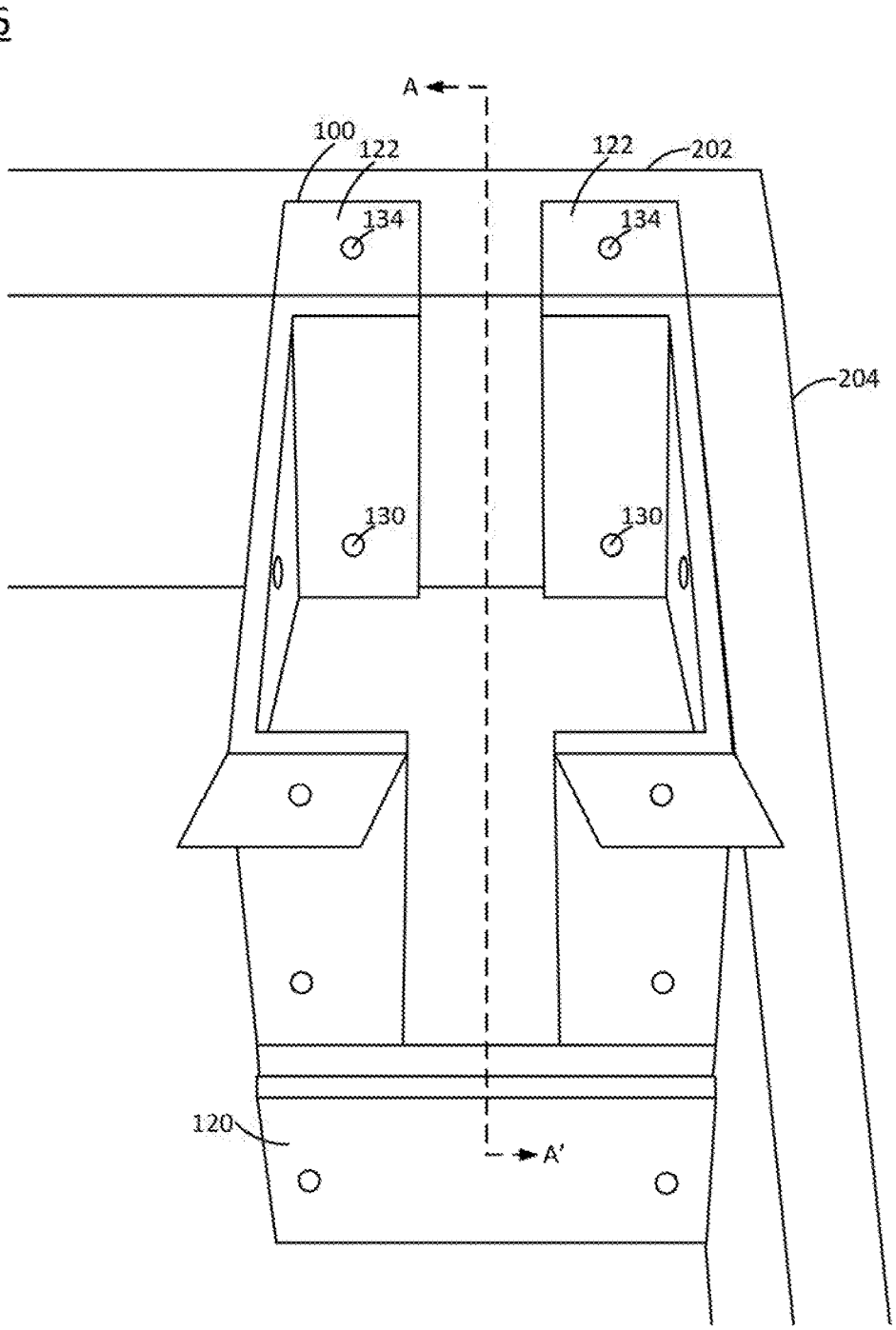
Figure 3A:
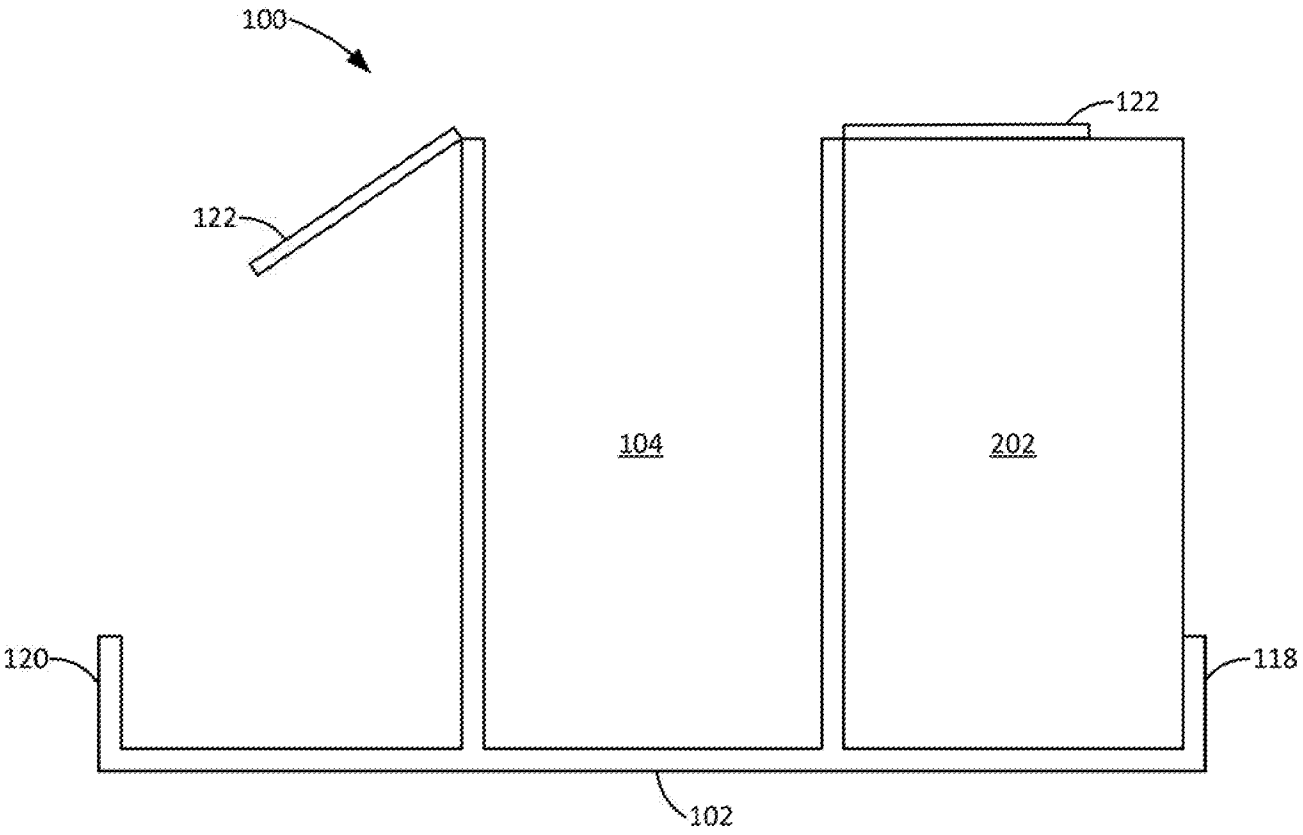
FIGS. 3A-3E are cross sectional views of certain steps of the installation illustrated in FIGS. 2A-2E, taken along line A-A' of FIG. 2B.

As illustrated in FIG. 2B, which shows a close-up view of a portion of location 206 of the frame 200 of FIG. 2A, a bracket 100 may be installed on and under one of the rim joists 202. FIG. 3A illustrates a cross sectional view of this step. The bracket 100 may be configured in a manner similar to the bracket 100 of FIG. 1. In one example, the first end 116 of the base 102 of the bracket 100 may be slid beneath the rim joist 202, such that the rim joist 202 sits between the sleeve 104 and the first flange 118. In one example, where a double rim joist is used (e.g., such that two rim joists 202 are positioned flush against each other, the first flange 118 may be folded down (e.g. so that the first flange 118 is substantially coplanar with the base 102). In this case, the first flange 118 will rest along the bottoms of both rim joists. Two of the tabs 122 at the second end 108 of the sleeve 104 may be folded over the top of the rim joist 202.

Figure 2C:
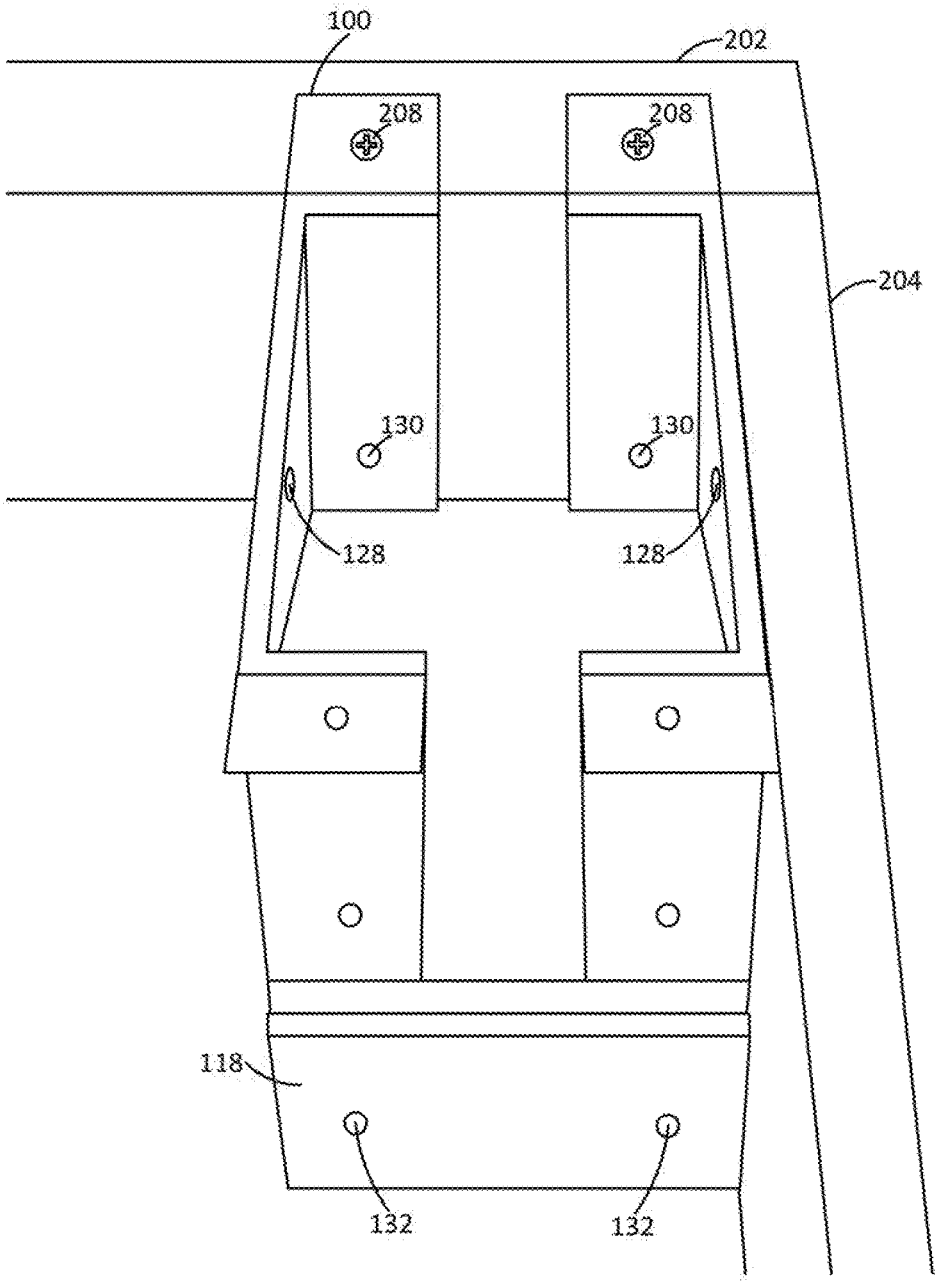
Figure 3B:
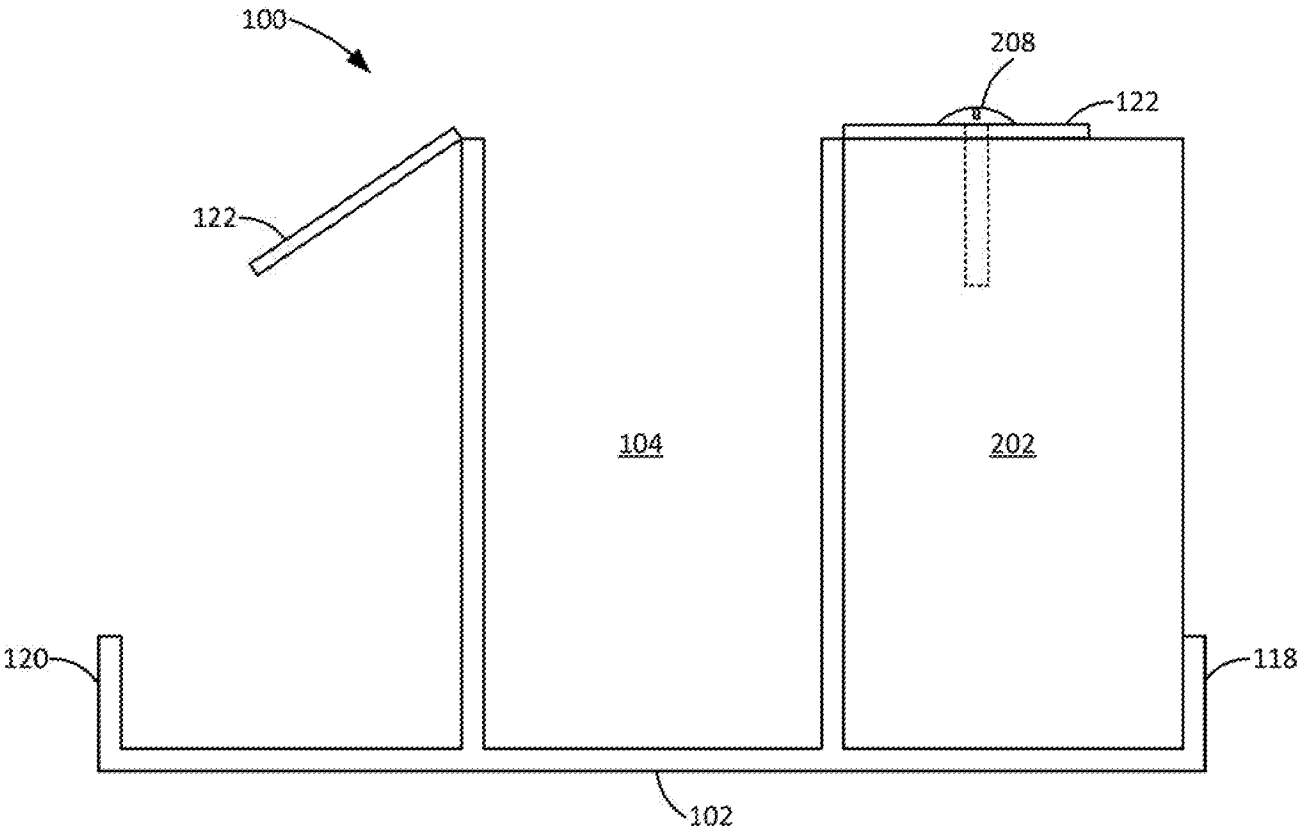

As illustrated in FIG. 2C and FIG. 3B, fasteners may next be lagged through at least some of the apertures in the bracket 100, in a direction toward (or perpendicular relative to) the base 102. For instance, fasteners 208 may be lagged through the apertures 134 in the tabs 122 that are folded over the top of the rim joist 202. This partially secures the bracket 100 to the rim joist 202.

Figure 3C:
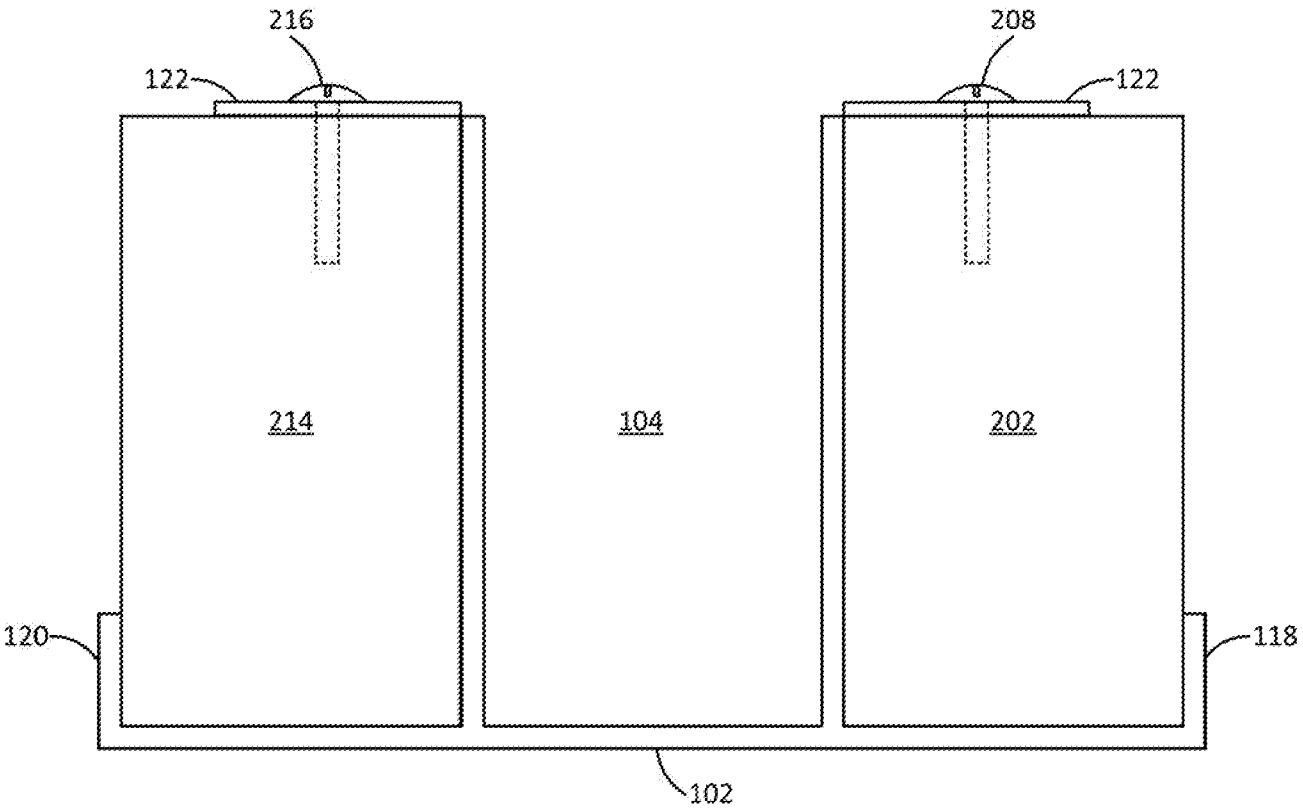
Figure 3D:
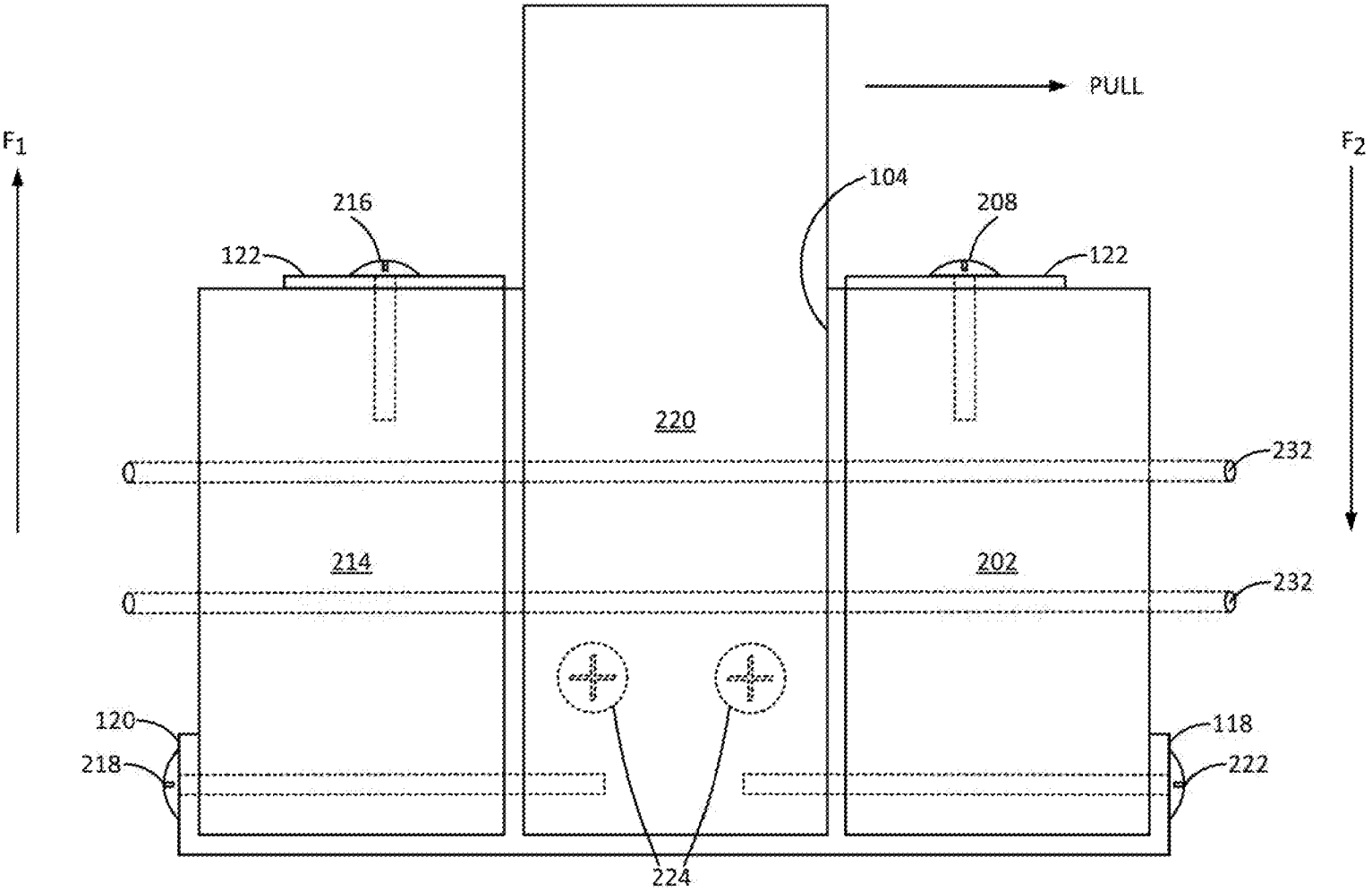
Figure 3E:
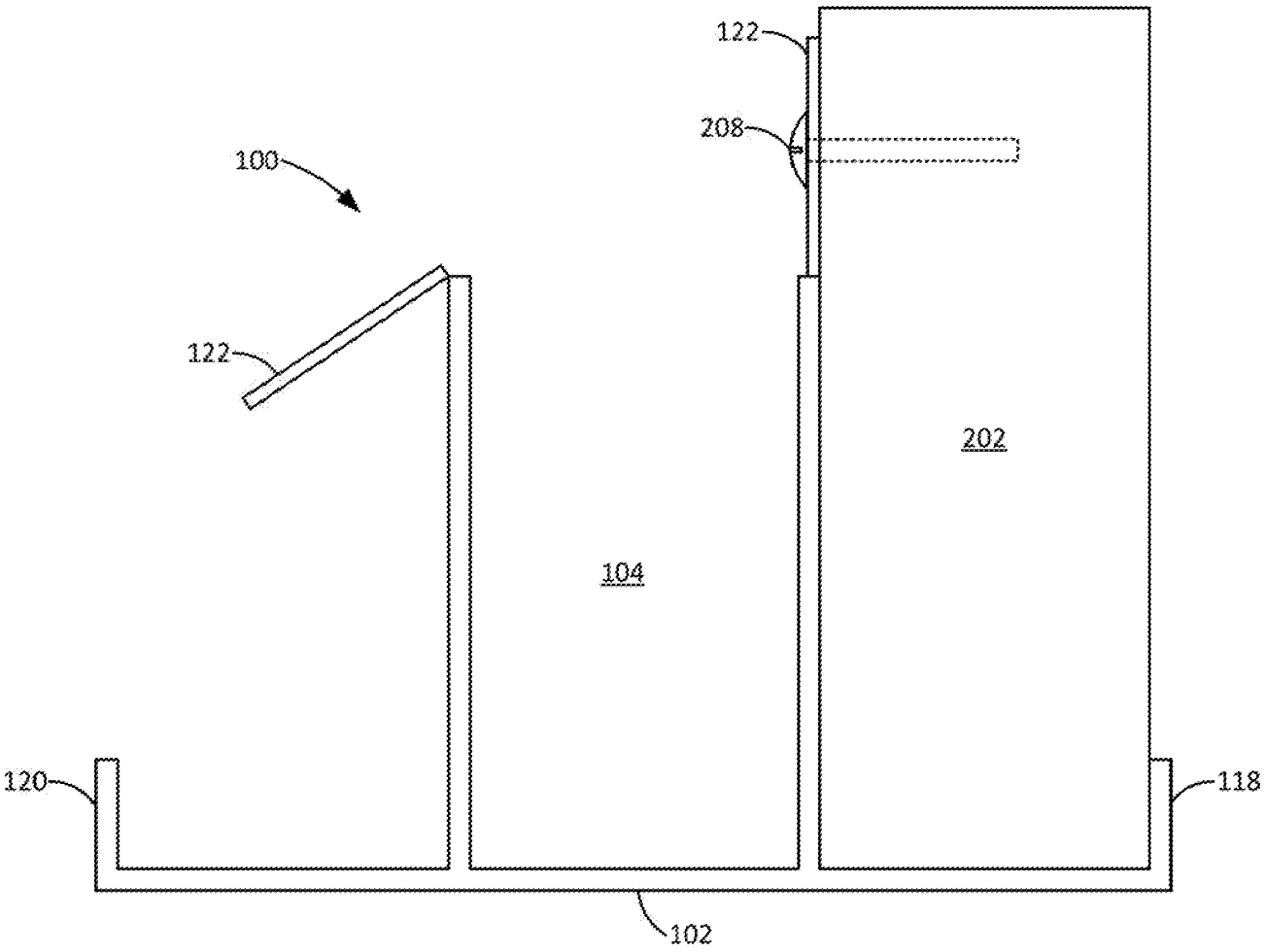

FIG. 3E illustrates an alternate example of the step shown in FIGS. 2C and 3B, where the rim joist 202 may be larger than shown in FIGS. 2C and 3B. For instance, if the rim joist 202 illustrated in FIGS. 2C and 3B is a 2 inch by 8 inch rim joist, then the rim joist 202 illustrated in FIG. 3E may be larger than an 8 inch rim joist. In the case of FIG. 3E, the tabs 122 at the second end 108 of the sleeve 104 may not be folded over the top of the rim joist 202, but may instead rest flush against the side of the rim joist 202 as shown. Fasteners 208 may be lagged through the apertures 134 in the tabs 122 in a direction toward the first flange 118 (or parallel relative to the base 102).

Figure 2D:
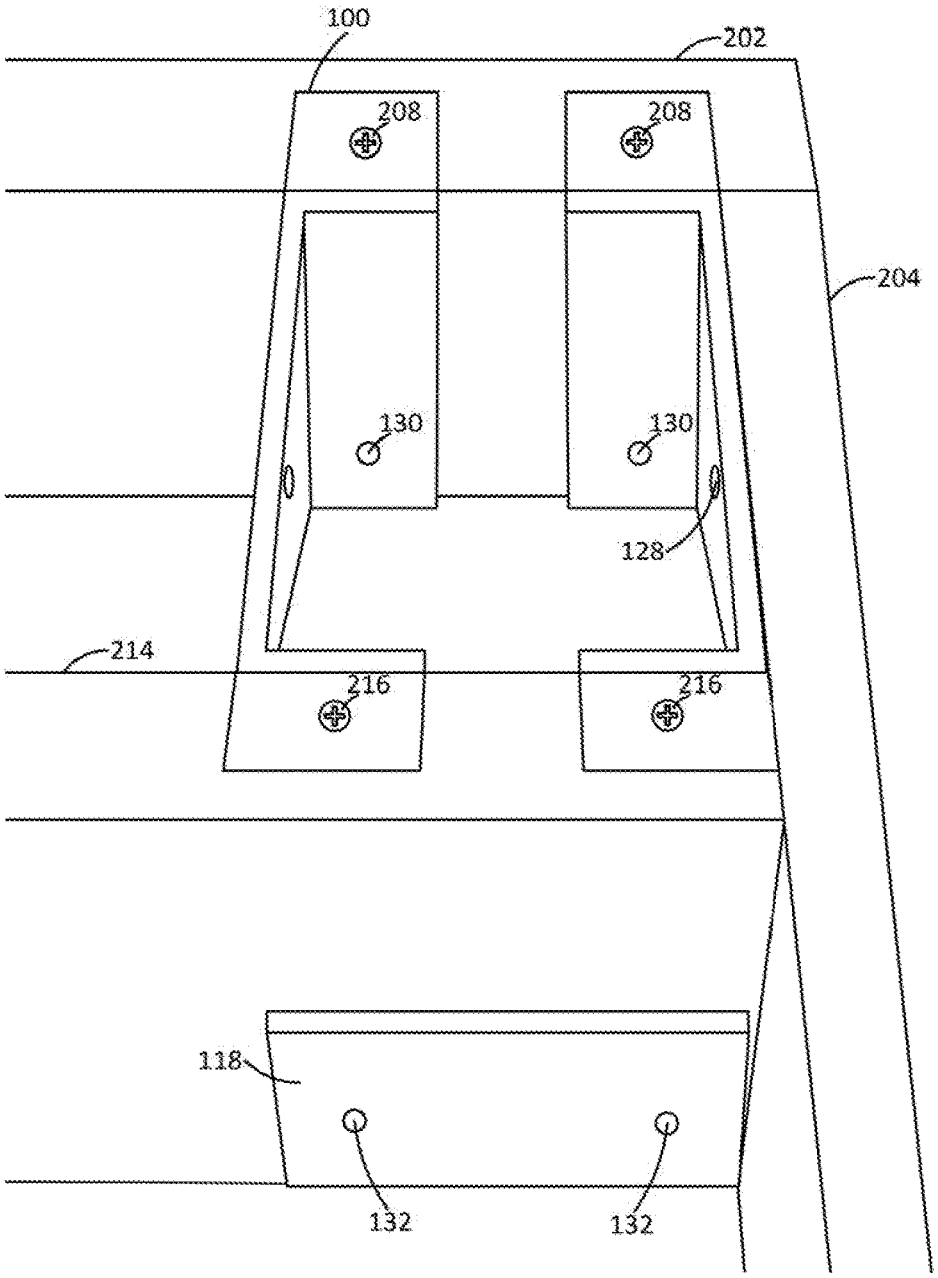

As illustrated in FIG. 2D and FIG. 3C, a reinforcing block 214 may next be installed in the frame 200. In one example, the reinforcing block 214 is installed so that the reinforcing block 214 sits between the sleeve 104 and the second flange 120. Although not shown in FIG. 2D and FIG. 3C, the reinforcing block 214 may be secured with fasteners to the frame 200 (e.g., the ends of the reinforcing block 214 may be secured to two respective deck joists, or a first end of the reinforcing block 214 may be secured to one deck joist while a second end of the reinforcing block 214 is secured to one rim joist, depending upon the location of installation). Two of the tabs 122 at the second end 108 of the sleeve 104 may be folded over the top of the reinforcing block 214. Fasteners 216 may be lagged through the apertures 134 in the tabs 122 that are folded over the top of the reinforcing block 214. This partially secures the bracket 100 to the reinforcing block 214. Moreover, the reinforcing block 214 ties the bracket 100 directly to the frame 200, as the bracket 100 is now secured on both ends to the rim joist 202 for counter-balance reinforcement and energy dispersal throughout the frame 200.

Figure 2E:
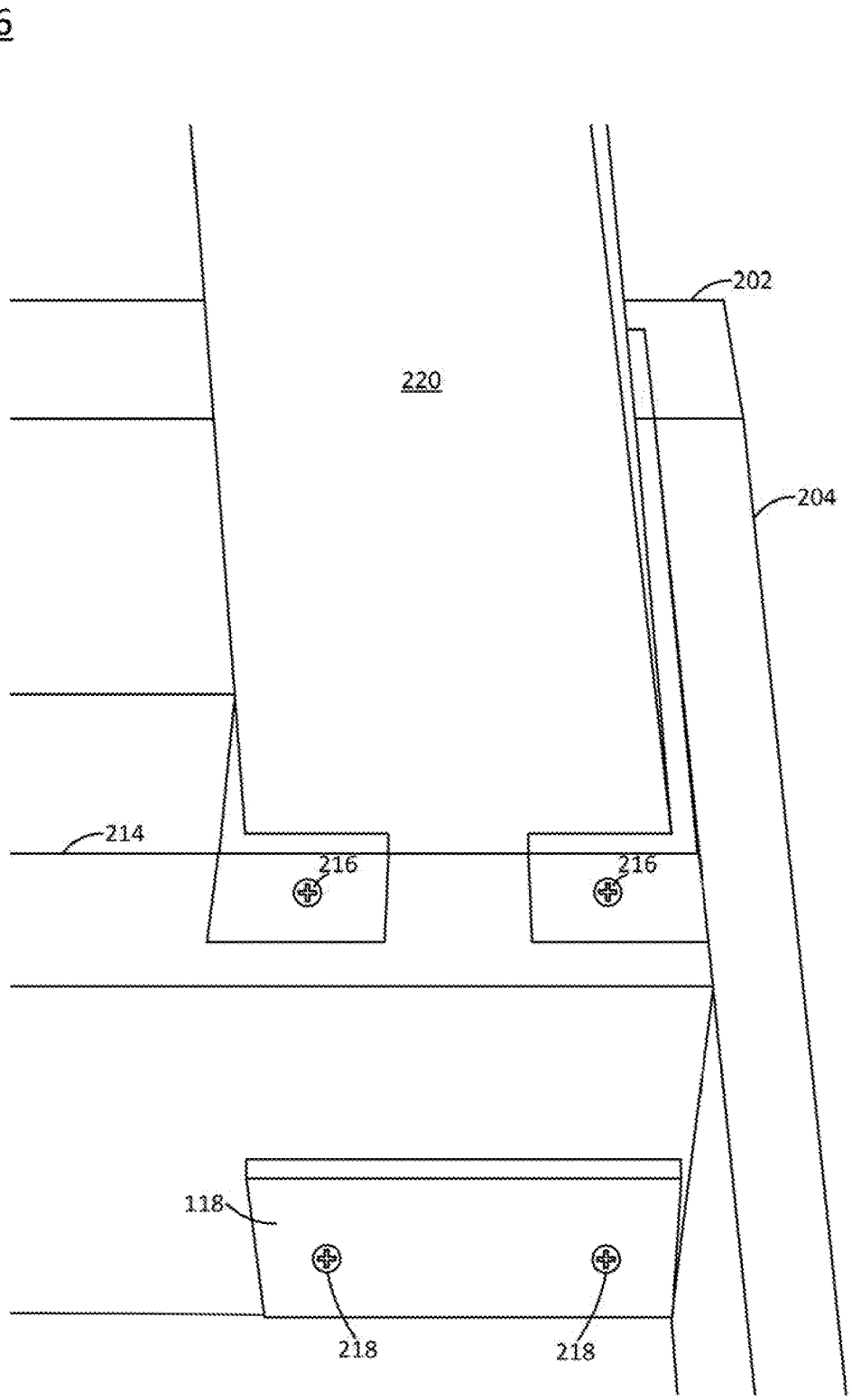

As illustrated in FIG. 2E and FIG. 3D, a post (e.g., a 4 inch by 4 inch pressure treated post) may be inserted into the sleeve 104. Fasteners 222 may secure the post 220 to the rim joist 202. In this case, the fasteners 222 may be lagged through the apertures 132 in the first flange 118, through the rim joist 202, through the apertures 130 in the sleeve 104, and into the post 220, as shown. In addition, fasteners 218 may also be lagged through the apertures 132 in the second flange 220, through the support block 214, through the apertures 130 in the sleeve 104, and into the post 220, as shown. In some examples, one or more bolts 232 may additionally be lagged all the way through the rim joist 202, through the gap 112 in one side of the sleeve 104, through the post 220, through the gap 112 on the opposite side of the sleeve 104, and through the reinforcing block 214.

Optionally, fasteners 224 may secure the post 220 to the deck joist 204 (as shown in FIG. 3D), e.g., if the bracket 100 is installed in a corner of the frame 200 where the rim joist 202 meets a deck joist 204. In this case, the fasteners 224 may be lagged through the deck joist 204, through the apertures 128 in the sleeve 104, and into the post 220. In an example where the bracket 100 is installed mid-span on the rim joist 202 (e.g., not in a corner where the rim joist 202 meets a deck joist 204), this step may be skipped.

Thus, as shown in FIG. 3D, the bracket 100 allows the full length of the rim joist 202 and the reinforcing block 214 to work together to counter balance the top pull load on the post 220 in any direction. Specifically, the rim joist 202 and the reinforcing block 214 push and pull in opposite directions to transfer and distribute pressures and loads directly to the deck sub structure, as opposed to using just the width of the rim joist 202 for structural reinforcement of the post. For instance, when a pull force is applied to the post 220 as shown in FIG. 3D, the bracket 100 pulls the rim joist and reinforcing block in opposite directions both up and down (as shown by force arrows $F_1$ and $F_2$), as well as in and out.

As discussed above, FIGS. 2A-2D illustrate only one example installation of the bracket 100. Specifically, FIGS. 2A-2D illustrate an example in which the bracket 100 is installed in a corner of the frame 200 (e.g., where two joists meet). However, the bracket 100 may also be installed to secure a post mid-span on a joist, i.e., in the middle of the joist as opposed to where the joist meets another joist.

Figure 4:
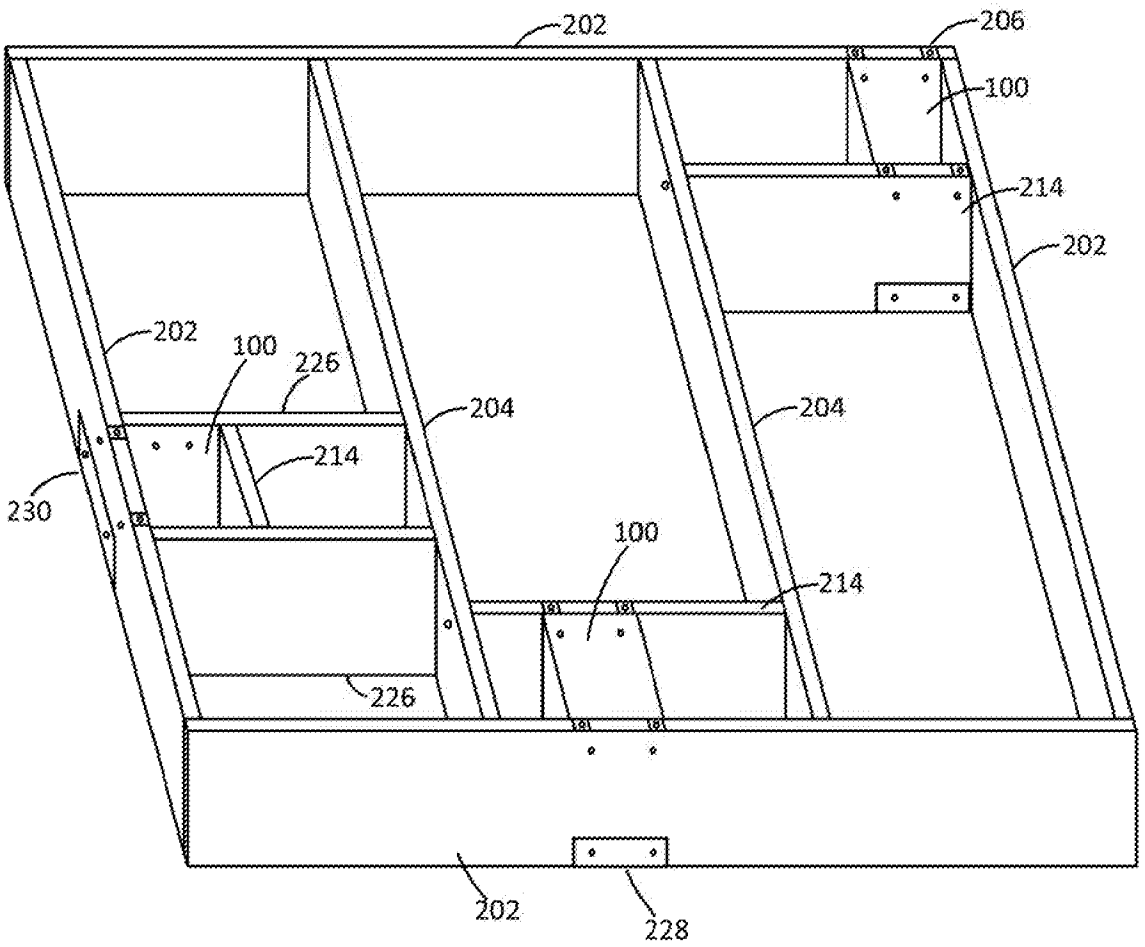
FIG. 4 illustrates several example installation locations of the bracket of FIG. 1.

FIG. 4 illustrates several example installation locations of the bracket 100 of FIG. 1. For instance, the location 206 illustrates the installation shown in FIG. 2A, where the bracket 100 is installed in a corner of the frame 200 (i.e., where two rim joists 202 meet). In this case, the reinforcing block 214 is installed parallel to one rim joist 202 and perpendicular to the other rim joist 202 (e.g., so that the reinforcing block is secured between one rim joist 202 and an adjacent deck joist 204).

The location 228, however, illustrates an example in which the bracket 100 is installed mid-span on a rim joist 202, between two deck joists 204. In this case, the reinforcing block 214 is installed parallel to the rim joist 202 (or perpendicular to the deck joists 204 to which the bracket 100 is secured).

Figure 5:
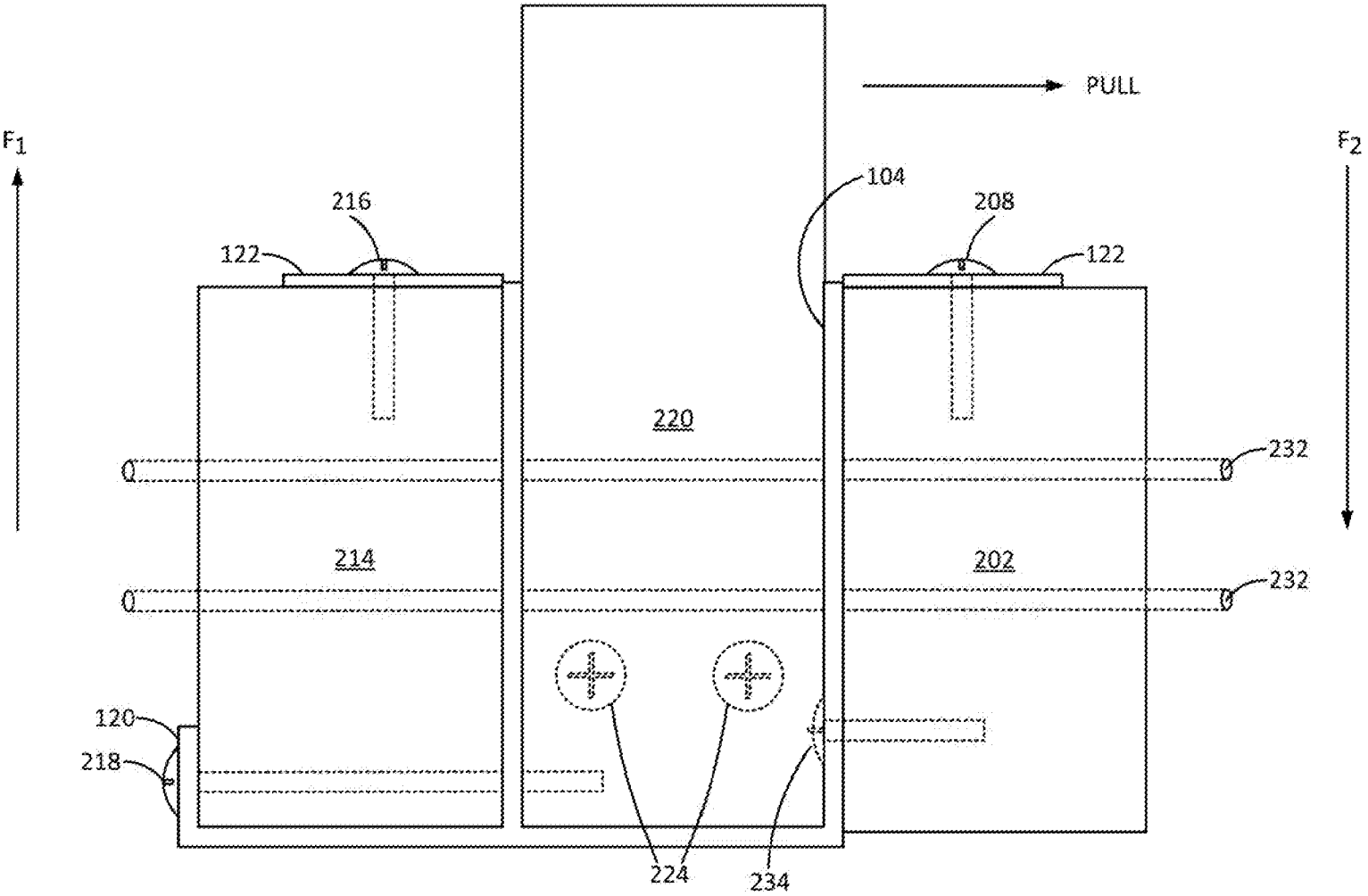
FIG. 5 illustrates a cross sectional view of an alternate example of the bracket.

FIG. 5 illustrates a cross sectional view of an alternate example of the bracket 100. Similar reference numerals to those used in the previous figures are used for similar components in FIG. 5. In the example illustrated in FIG. 5, the planar base 102 is shortened, such that the base 102 extends to a single side of the sleeve 104.

More particularly, the first flange 118 and the portion of the base 102 connecting the first flange 118 to the sleeve 104 have been removed in FIG. 5. In this case, the bracket 100 is secured to the rim joist 202 by fasteners 208 that are driven through the tabs 122 (e.g., through apertures of the fourth plurality of apertures 134). The bracket 100 may be further secured to the rim joist 202 by fasteners 234 that are driven through apertures (e.g., of the second plurality of apertures 130) in the side of the sleeve 104 that is positioned flush against the rim joist 202. Thus, the bracket 100 of FIG. 5 does not wrap around the bottom of the rim joist 202.

The bracket 100 is secured to the reinforcing block 214 as described above.

The location 230 illustrates another example in which the bracket is installed mid-span on a rim joist 202. However, in this case, the bracket 100 is situated between two joists 226 that are secured between the rim joist 202 and an adjacent deck joist 204. In this case, the reinforcing block 214 is installed parallel to the rim joist 202 (or perpendicular to the joists 226 to which the bracket 100 is secured). Although various embodiments which incorporate the teachings of the present disclosure have been shown and described in detail herein, those skilled in the art can readily devise many other varied embodiments that still incorporate these teachings. In addition, while various embodiments have been described above, it should be understood that they have been presented by way of example only, and not limitation. Thus, the breadth and scope of a claimed embodiment should not be limited by any of the above-described exemplary embodiments, but should be defined only in accordance with the following claims and their equivalents.

What is claimed is:

1. An apparatus, comprising:

a planar base having a first end and a second end;

a first flange extending from the first end of the planar base in a perpendicular orientation relative to the planar base;

a second flange extending from the second end of the planar base in a perpendicular orientation relative to the planar base;

a plurality of apertures formed in the first flange and the second flange; and a hollow sleeve extending from the planar base in a perpendicular orientation relative to the planar base, wherein the hollow sleeve is positioned between the first end of the planar base and the second end of the planar base, wherein a first channel is bounded by the first flange and the hollow sleeve, and a second channel is bounded by the second flange and the hollow sleeve, such that the first channel is physically separated from the second channel by the hollow sleeve and such that the first channel is positioned in a parallel orientation relative to the second channel.

2. The apparatus of claim 1, wherein the hollow sleeve has a first end and a second end, wherein the first end of the hollow sleeve is coupled to the planar base such that the first end of the hollow sleeve is closed, and the second end of the hollow sleeve is open.

3. The apparatus of claim 2, further comprising:

a plurality of tabs coupled to a perimeter of the second end of the hollow sleeve, wherein each tab of the plurality of tabs is coupled to a corner of the second end of the hollow sleeve.

4. The apparatus of claim 3, wherein each tab of the plurality of tabs is hinged to bend around a bending axis.

5. The apparatus of claim 4, wherein the bending axis extends in a direction parallel to the first flange and the second flange.

6. The apparatus of claim 3, wherein the plurality of tabs comprises:

two tabs extending outward from the hollow sleeve in a direction toward the first end of the planar base; and two tabs extending outward from the hollow sleeve in a direction toward the second end of the planar base.

7. The apparatus of claim 3, wherein each tab of the plurality of tabs includes an aperture.

8. The apparatus of claim 1, wherein the hollow sleeve includes four sides arranged to form a rectangular tube.

9. The apparatus of claim 8, wherein a first side and a second side of the four sides each includes a gap.

10. The apparatus of claim 9, wherein the first side and the second side are non-adjacent.

11. The apparatus of claim 8, further comprising:

a first plurality of apertures formed in a third side and a fourth side of the four sides; and a second plurality of apertures formed in the first side and the second side of the four sides.

12. The apparatus of claim 1, wherein the apparatus is formed from stamped metal.

13. The apparatus of claim 1, further comprising:

a plurality of apertures formed in the hollow sleeve.

14. The apparatus of claim 13, wherein each aperture of the plurality of apertures formed in the hollow sleeve is collinear with at least one aperture of the plurality of apertures formed in the first flange and the second flange.

15. An apparatus, comprising:

a hollow sleeve having a first side, a second side, a third side, and a fourth side arranged to form a rectangular tube, wherein the rectangular tube has a first end that is closed and a second end that is open;

a planar base coupled to the first end of the rectangular tube and extending from the first side of the rectangular tube in a perpendicular orientation relative to the hollow sleeve; and a first flange extending from a first end of the planar base in a parallel orientation relative to the hollow sleeve;

a second flange extending from a second end of the planar base in a parallel orientation relative to the hollow sleeve; and a plurality of apertures formed in the first flange;

wherein a first channel is bounded by the first flange and the hollow sleeve, and a second channel is bounded by the second flange and the hollow sleeve, such that the first channel is physically separated from the second channel by the hollow sleeve and such that the first channel is positioned in a parallel orientation relative to the second channel.

16. An apparatus, comprising:

a planar base having a first end and a second end;

a first flange extending from the first end of the planar base in a perpendicular orientation relative to the planar base;

a second flange extending from the second end of the planar base in a perpendicular orientation relative to the planar base;

a hollow sleeve extending from the planar base in a perpendicular orientation relative to the planar base, wherein the hollow sleeve is positioned between the first end of the planar base and the second end of the planar base, and wherein the hollow sleeve has a first end and a second end, wherein the first end of the hollow sleeve is coupled to the planar base such that the first end of the hollow sleeve is closed, and the second end of the hollow sleeve is open; and a plurality of tabs coupled to a perimeter of the second end of the hollow sleeve, wherein each tab of the plurality of tabs is coupled to a corner of the second end of the hollow sleeve.

17. The apparatus of claim 16, wherein each tab of the plurality of tabs is hinged to bend around a bending axis.

18. The apparatus of claim 17, wherein the bending axis extends in a direction parallel to the first flange and the second flange.

19. The apparatus of claim 16, wherein the plurality of tabs comprises:

two tabs extending outward from the hollow sleeve in a direction toward the first end of the planar base; and two tabs extending outward from the hollow sleeve in a direction toward the second end of the planar base.

20. The apparatus of claim 16, wherein each tab of the plurality of tabs includes an aperture.

* * * * *